US005100179A

United States Patent [19]

Burden et al.

[11] Patent Number: 5,100,179

[45] Date of Patent: Mar. 31, 1992

[54] ADVERTISING INSERT PIECE

[75] Inventors: Mark E. Burden; Donald G. Bouquin, both of Apex; John M. Barron, Garner; James H. Aikin, Cary, all of N.C.

[73] Assignee: Henry Wurst, Inc., North Kansas City, Mo.

[21] Appl. No.: 673,414

[22] Filed: Mar. 22, 1991

[51] Int. Cl.[5] ..... B42D 15/00

[52] U.S. Cl. ..... 283/62; 283/56; 229/92.8

[58] Field of Search ..... 283/56, 62; 229/68, 229/73, 92, 92.1, 92.8

[56] References Cited

U.S. PATENT DOCUMENTS

| | | | |
|---|---|---|---|
| 1,311,397 | 7/1919 | Herter . | |
| 1,944,853 | 1/1934 | Unger . | |
| 1,957,374 | 5/1934 | Unger . | |
| 2,153,504 | 4/1939 | Didier . | |
| 2,270,455 | 1/1942 | Lichter . | |
| 2,279,164 | 4/1942 | Gettleman . | |
| 2,328,380 | 8/1943 | Feder . | |
| 2,616,612 | 11/1952 | Guttman | 283/56 X |
| 4,011,985 | 3/1977 | Simson | 283/56 X |
| 4,892,246 | 1/1990 | Norman . | |
| 5,005,871 | 4/1991 | Anderson | 283/62 X |

FOREIGN PATENT DOCUMENTS

| | | | |
|---|---|---|---|
| 2750862 | 5/1979 | Fed. Rep. of Germany | 283/56 |

*Primary Examiner*—P. W. Echols
*Assistant Examiner*—Willmon Fridie, Jr.
*Attorney, Agent, or Firm*—Hovey, Williams, Timmons & Collins

[57] ABSTRACT

An advertising insert piece is designed for presenting a detachable postcard forming part of a second sheet connected to a first sheet. The second sheet is of reduced size relative to the first sheet to which it is connected. The second sheet includes a single line of weakness dividing the second sheet into a detachable postcard portion and a non-detachable portion adhered to said first sheet. Indicia are printed on at least a portion of each side of the first and second sheets, the first and second sheets being preferably adhesively joined at opposing non-indicia bearing surfaces.

4 Claims, 2 Drawing Sheets

ADVERTISING INSERT PIECE

BACKGROUND OF THE INVENTION

1. Field of the Invention

This invention broadly concerns printed advertising inserts which include a detachable return postcard. The insert hereof includes a first sheet and a reduced sized second sheet joined together at a portion of each, the second sheet including a detachable postcard portion which may be severed from the remainder along a single line of weakness.

2. Description of the Prior Art

The advertising of various articles and services often includes "free standing inserts" which are advertising pieces normally delivered to intended customers by inserting the piece in a newspaper or other similar carrier publication delivered to the consumer. The success of the advertising campaign is directly dependent on the cost and the response rate. Thus, maximum efficiency for any campaign is a function of minimizing expense and maximizing the response rate. The use of postcards which are prefranked and commonly marked as "Business Reply Mail" has been found to promote responses while keeping costs to a minimum.

An advertising insert piece may include the return postcard as an integral part thereof. This makes it easy for the recipient to write in a response and detach the postcard while retaining the balance of the piece which includes the advertising message.

A number of ways have been explored for presenting advertising materials including a return postcard. U.S. Pat. No. 1,957,374 to Unger discloses an advertising device which includes a separable postcard overlying a blotter portion. The postcard includes several lines of weakness and forms part of a backing sheet which is co-extensive with the underlying blotter portion.

Another approach is shown in U.S. Pat. No. 2,270,455 to Lichter, which discloses a mailing circular where the return postcard is created from relatively thin paper stock by folding over one layer of the paper to provide the necessary stiffness and rigidity for the card and paper to provide the necessary stiffness and rigidity for the card and separable by perforations or other means defining a weakening line. The overlying layers making up the postcard are thus entirely detached.

U.S. Pat. No. 4,892,246 to Norman discloses a business form with a tear out postcard. The business form includes two plies of material of the same shape and size, the plies being joined around their peripheries only. The postcard portion is enclosed within the peripheries of one of the co-extensive plies and requires several lines of weakness to separate.

There has developed a need for a more economical advertising insert which costs less to manufacture, presents a severable return postcard and is easy to use. The desired advertising insert must have an impact on the recipient and be readily adapted to inclusion in a newspaper as a free standing insert.

SUMMARY OF THE INVENTION

The advertising insert of the present invention presents a significant advance over the prior art by reducing the amount of material and labor required to manufacture the insert and by making it easier to use. The insert includes indicia on both sides and a detachable postcard portion which is easily removable from the remainder of the insert. The insert economically uses materials by having a second sheet overlying a first sheet with the second sheet being of relatively reduced size.

In preferred embodiments, the insert utilizes a first sheet which includes printing on both sides to carry an advertising or other message, and a second sheet which is reduced in size relative to the first sheet. The second sheet includes a line of weakness which separates it into detachable and non-detachable portions. The non-detachable portion is adhesively joined to the first sheet. The detachable portion is thus easily severable from the remainder of the insert along a single line of weakness.

The second sheet is preferably oriented on the first sheet whereby the margins of the second sheet are co-extensive with the edges of the first sheet, the exception being that one margin of the second sheet extends across the first sheet between opposing first and second peripheral edges of the first sheet. Thus, one of the edges of the detachable postcard portion is co-extensive with one of the corners of the larger first sheet, making indexing and severing of the postcard easier than in the prior art while protecting the insert from damage or loss.

It will be appreciated however, that the card may be carried at other locations on the second sheet within the contemplation of this invention.

It may be appreciated that the present invention need uses less paper stock than prior art inserts, thus reducing cost and impact to the environment due to excess harvesting of trees and disposal of waste paper. In addition, the postcard may be easily indexed and grasped by the recipient, and torn in a convenient manner along a single line of weakness. The advertising insert thus presents advantages both to the sender in terms of cost and to the recipient in terms of ease of use.

DESCRIPTION OF THE PREFERRED EMBODIMENT

Figure 1:
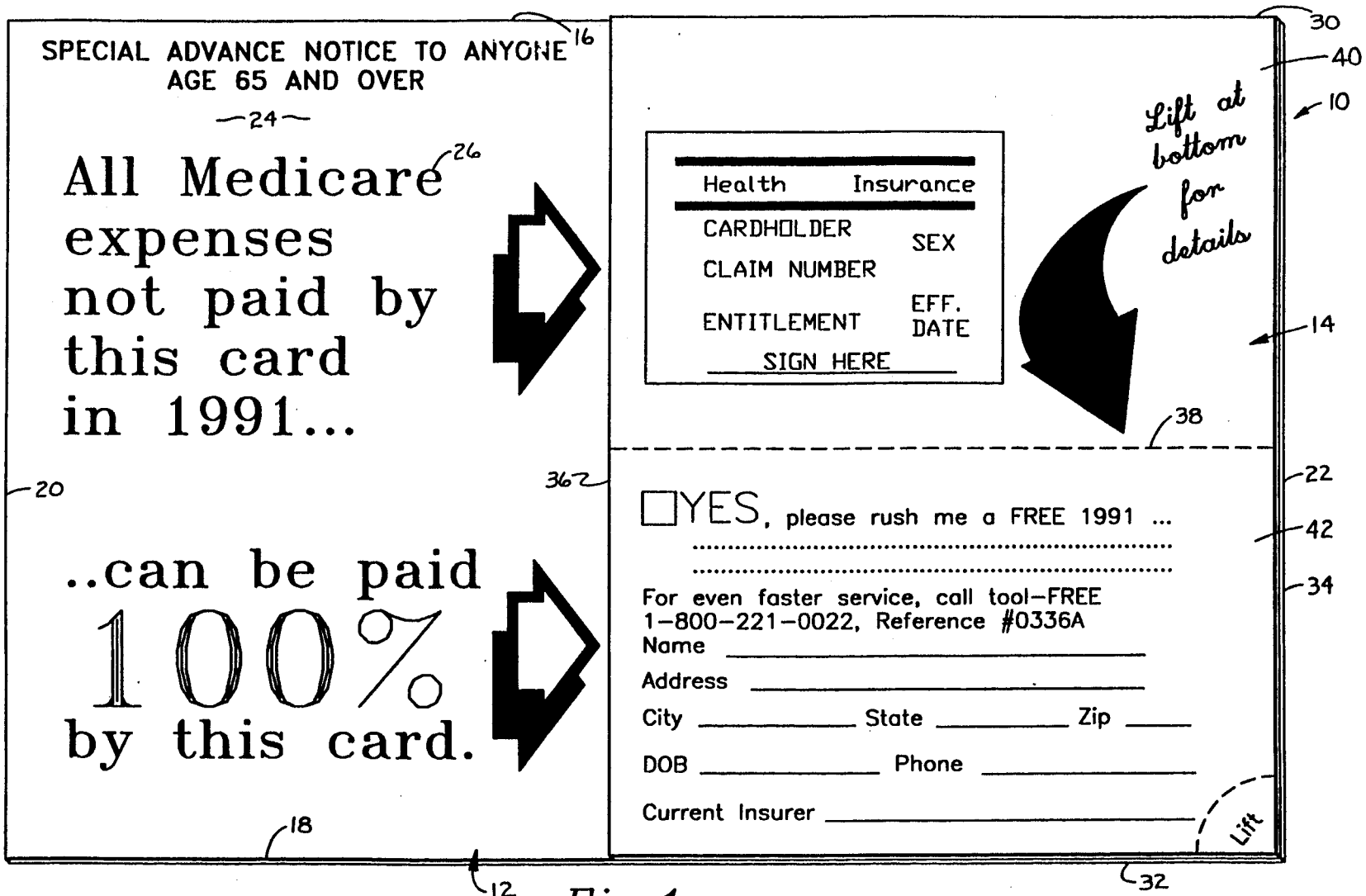
FIG. 1 is a plan view of one side of an advertising insert having a detachable postcard in accordance with the present invention.

Referring now to the drawing, an advertising insert piece 10 is broadly shown in FIG. 1 and includes a first sheet 12 and a second sheet 14. First sheet 12 is defined by top peripheral edge 16, bottom peripheral edge 18, left peripheral edge 20 and right peripheral edge 22 defining an area therewithin. First sheet 12 also includes a first side 24 including indicia 26 on at least a portion thereof, and a second side 28 as shown in Second sheet 14 includes a top or first peripheral margin 30 and a bottom or second peripheral margin 32, as well as an outer margin 34 and an inner margin 36 defining the area thereof. A single line of weakness 38 bisects second sheet 14 into non-detachable portion 40 and detachable portion 42 which serves as a severable return post card.

Figures 2, 3, 4, 5, 6:
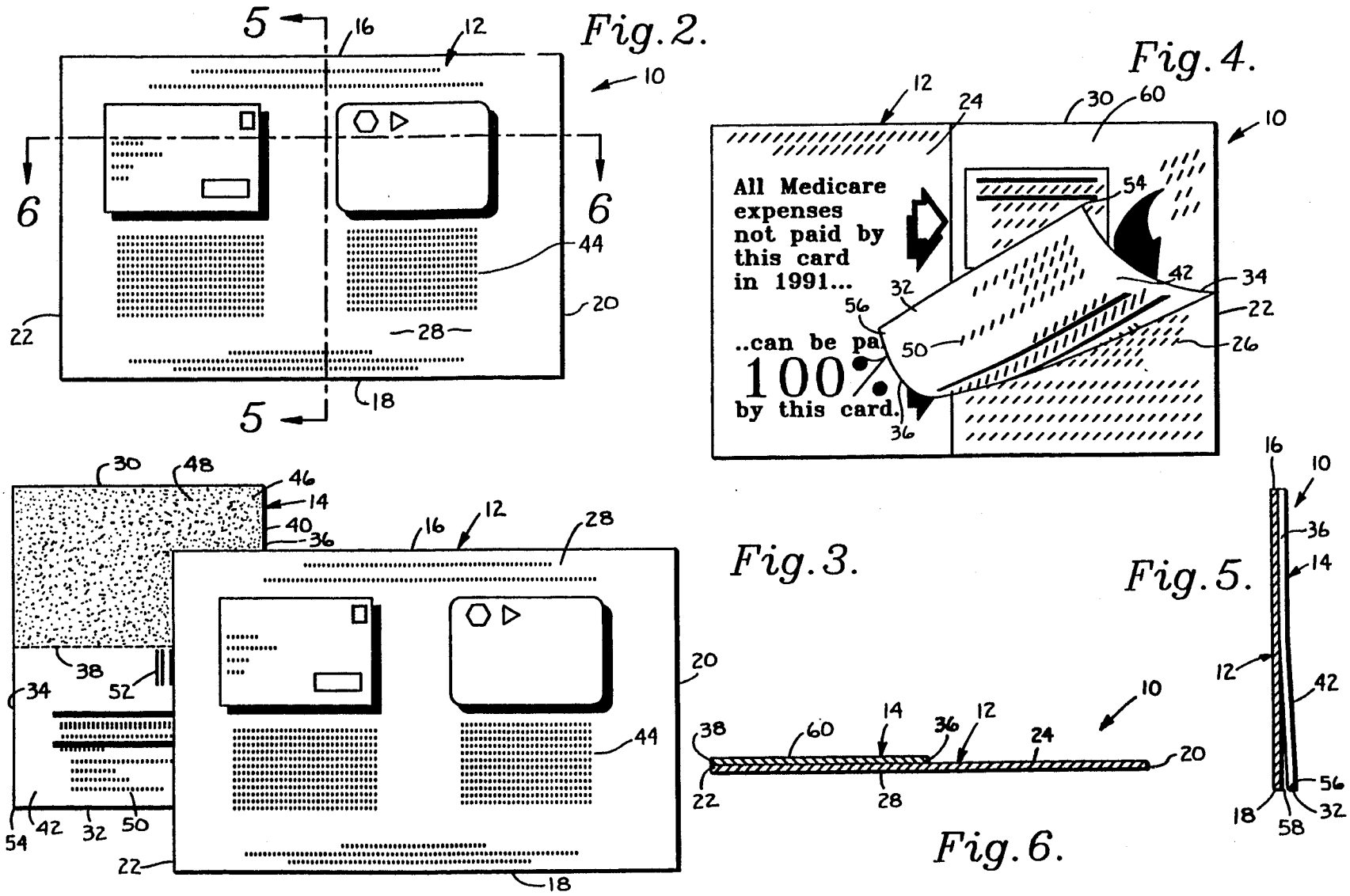
FIG. 2 is a reduced size plan view of the other side of the advertising insert shown in FIG. 1.
FIG. 3 is a plan view similar to FIG. 2 but showing a first sheet and a second sheet of the insert separated prior to joining.
FIG. 4 is a reduced size plane view of the one side shown in FIG. 1 but with a part of the detachable postcard lifted.
FIG. 5 is a cross-sectional view taken along line 5—5 of FIG. 2.
FIG. 6 is a cross-sectional view taken along line 6—6 of FIG. 2.

Turning now to FIG. 2, second side 28 of first sheet 12 is shown which includes alternate indicia 44 displayed thereon to present a further advertising message. It may thus be appreciated from FIGS. 2 and 3 that second sheet 14 is not normally visible when viewing second side 28 of first sheet 12, but is clearly visible when viewing first side 24 of first sheet 12.

As may be seen in FIG. 3, a layer of adhesive 46 is interposed between rear side 48 of second sheet 14 and a portion of first side 24 of first sheet 12. The adhesive is preferably positioned over an indicia-free surface of non-detachable portion 40 and does not extend beyond line of weakness 38 dividing non-detachable portion 40 from detachable portion 42. As may be seen in FIG. 3, detachable portion 42 includes on the rear side thereof indicia 50 which represents a business reply mail return address designation. Rear side 48 also includes a franking designation or a stamp-receiving area 52.

Turning now to FIG. 4 which is a more schematic and less detailed representation of the showing in FIG. 1, the detachable portion 42 is shown being lifted by free corners 54 and 56 which reveals the remainder of the indicia 26 printed on first side 24 of first sheet 12. It may be also understood from a comparison of FIGS. 3 and 4 that second sheet 14 is approximately half the size of first sheet 12 and thus even though first peripheral margin 30, second peripheral margin 32 and outer margin 34 are all co-extensive with corresponding portions of top peripheral edge 16, bottom peripheral edge 18 and right peripheral edge 22 of first sheet 12, the detachable portion 42 which serves a severable return postcard may be easily removed by lifting up on either free corner 54 or free corner 56 and tearing along line of weakness 38 to detach portion 42 from the remainder of the advertising insert piece 10 which thereafter includes non-detachable portion 40 joined by adhesive 46 to a portion of first side 24 of first sheet 12. When detachable portion 42 is lifted by free corners 54 and 56, further indicia 26 printed on first side 24 of first sheet 12 is revealed.

FIG. 5 shows the advertising insert piece 10 to reveal that inner edge 36 of second sheet 14 extends between the top peripheral edge 16 and the bottom peripheral edge 18 of the first sheet and that corner 56 is not adhered to first sheet 12 and thus presents a space 58 located between second peripheral margin 32 and bottom peripheral edge 18. Space 58 allows easy direct indexing and grasping of the detachable portion 24 without the necessity of breaking any lines of weakness to grasp free corners 54 and 56.

Finally, in FIG. 6, it may be seen that second sheet 14 only partially overlaps first sheet 12 and that front side 60 of second sheet 14 is positioned for viewing of the indicia printed thereon while only a portion of the rear side 48 of second sheet 14 is printed, this comprising primarily indicia 50 corresponding to the business reply mail and return address designation. Advantageously, indicia 26 and alternate indicia 44 may be printed on opposite sides of first sheet 12 except that portion in engagement with adhesive 46 and rear side 48 of non-detachable portion 40.

The steps of creating the advertising insert piece 10 involve first printing on the appropriate portions of first sheet 12 and second sheet 14 and creating a single line of weakness extending across second sheet 14 essentially perpendicular to inner margin 36. A layer of adhesive 46 is then applied to either a portion of second sheet 14 corresponding to non-detachable portion 40 or the opposite portion of first side 24 of first sheet 12. The second sheet 14 is then oriented relative to larger first sheet 12 whereby outer margin 34 is substantially co-extensive with one of either left edge 20 or right edge 22 and first peripheral margin 30 is co-extensive with top peripheral edge 16 while second peripheral margin 32 is co-extensive with bottom peripheral edge 18. After joining of first sheet 12 to second sheet 14 by adhesive 46, corners 54 and 56 remain free and a space remains between bottom peripheral edge 18 and second peripheral margin 32. Accordingly, severable return postcard making up detachable portion 42 may be easily lifted along either corner 54 or corner 56 or torn from first sheet 12 along line of weakness 38 by grasping outer margin 34, inner margin 36 or second peripheral margin 32 of detachable portion 42, all of which are unconnected to the underlying first sheet 12 and thus readily graspable.

We claim:

1. An advertising insert piece for conveying information and receiving a response thereto comprising:

a first sheet having surrounding edges defining an area therewithin and presenting a first side and a second side, said first side presenting indicia thereon, said second side presenting an indicia-bearing portion and a substantially indicia-free portion;

a second sheet having a surrounding margin defining a reduced area relative to said first sheet and presenting a front side and a rear side, said front side presenting indicia thereon, said rear side presenting an indicia-bearing portion and a non-indicia bearing portion;

a single line of weakening extending completely across said second sheet for defining detachable and non-detachable portions of said second sheet but not into said first sheet, said detachable portion including the portion of the rear side presenting indicia thereon; and means securing at least a part of said non-detachable portion of said second sheet to the second side of said first sheet with the indicia-free portion of said first sheet positioned opposite the non-indicia bearing portion of said second side whereby said detachable portion of said second sheet is positioned on said first sheet with a portion of the margin of said second sheet located in overlying relationship to a portion of said first sheet interior to said edge and at an angle relative to said line of weakening, and wherein a remaining portion of said margin including a portion of the margin of said detachable portion is positioned co-extensive with portions of the surrounding edge of said first sheet wherein said detachable portion presents a free marginal edge except for that portion connected to the non-detachable portion along the line of weakness.

2. An advertising insert piece as set forth in claim 1 wherein substantially the entire rear side of said non-detachable portion of said second sheet is adhesively bonded to said first sheet.

3. An advertising insert piece as set forth in claim 1 wherein said edge of said first sheet includes a top edge, a bottom edge, a left edge and a right edge, and said second sheet includes a first peripheral margin, a second peripheral margin, an outer margin and an inner margin, said top edge and said bottom edge being substantially collocated with said first peripheral margin and said second peripheral margin.

4. An advertising insert piece as set forth in claim 3 wherein only one of said left edge and said right edge is collocated with said outer margin and said inner margin.

* * * * *